US005626080A

United States Patent [19]

Trenner et al.

[11] Patent Number: 5,626,080

[45] Date of Patent: May 6, 1997

[54] TRAVELING CARRIAGE FOR THE TRANSPORTING OF WORKPIECES

[75] Inventors: Albrecht Trenner, Langendorf; Erich Grossenbacher, Derendingen, both of Switzerland

[73] Assignee: Montech AG, Germany

[21] Appl. No.: 603,612

[22] Filed: Feb. 21, 1996

[30] Foreign Application Priority Data

Feb. 25, 1995 [DE] Germany ..... 195 06 670.7

[51] Int. Cl.[6] ..... B61B 13/04

[52] U.S. Cl. ..... 104/118; 105/141; 384/549

[58] Field of Search ..... 104/118, 119, 104/93; 105/141, 144; 191/56, 57; 384/57, 58, 447, 449, 549; 295/7

[56] References Cited

U.S. PATENT DOCUMENTS

| | | | |
|---|---|---|---|
| 2,537,866 | 1/1951 | Tanner | 191/57 |
| 3,044,820 | 7/1962 | Cox | 295/7 |
| 4,422,384 | 12/1983 | Johnson et al. | 104/119 |
| 4,815,863 | 3/1989 | Forster | 384/58 |
| 5,235,917 | 8/1993 | Luck et al. | 104/119 |
| 5,303,656 | 4/1994 | Makimura et al. | 104/119 |

FOREIGN PATENT DOCUMENTS 0618123 3/1994 European Pat. Off. .

*Primary Examiner*—S. Joseph Morano
*Attorney, Agent, or Firm*—Bachman & LaPointe, P.C.

[57] ABSTRACT

In a traveling carriage for the transporting of workpieces, material, or the like, particularly in a longitudinal transfer system on a rail against which travel rollers (3, 4) which move at least one support plate (7) rest. The support plate (7) is connected turnably around a swivel shaft (12) on the one hand to the travel rollers (3, 4) and on the other hand to a mounting plate (11) for the workpieces, material, or the like. In this connection, straight-line guide rollers (13) are arranged, offset from the swivel shaft (12), on the support plate (7) on both sides of the rail (2).

9 Claims, 5 Drawing Sheets

TRAVELING CARRIAGE FOR THE TRANSPORTING OF WORKPIECES

The present invention relates to a traveling carriage for the transporting of workpieces, material, or the like, particularly in a longitudinal transfer system on a rail on which travel rollers rest which move at least one support plate, this support plate being connected turnably around a swivel axis on the one hand to the travel rollers and on the other hand to a mounting plate for the workpieces, material, or the like.

Such a traveling carriage is described, for instance, in EP-A 0 618 123, to which, in particular, reference is had in the present case for all details which are not further described below.

The object of the present invention to improve in many details the traveling carriage disclosed in EP-A 0 618 123.

In order to achieve this object, straight-line guide rollers are arranged, shifted from the swivel shaft, on the support plate.

Since the traveling carriage moves along curves, suitable means must effect a straightening of the traveling carriage after passage around a curve without the travel rollers being excessively called upon for this. In accordance with EP-A 0 618 123, this is done by means of relatively complicated mechanical parts which cooperate with each other. In accordance with the present invention, however, two simple straight-line guide rollers are sufficient, they preferably having a covering of elastic material. This elastic material is preferably polyurethane, the polyurethane being vulcanized on a sleeve. This sleeve is seated on a pivot pin around which it can turn. It has been found in actual practice that these straight-line rollers are sufficient in order on the one hand to realign the traveling carriage precisely straight with respect to the rail. Furthermore, it has been found that no jamming takes place upon travel around extreme curves.

At least four travel rollers should be provided, spaced from each other in the direction of travel. In such case, in each case two travel rollers are arranged in pairs on, in each case, a support plate, these support plates being located in front and behind on the mounting plate. Each support plate is turnable with respect to the mounting plate.

In this case, it is logical to associate in each case two straight-line rollers with each support plate, the straight-line rollers of the rear support plate being provided, as seen in the direction of travel, behind the swivel shaft of the support plate and the straight-line rollers of the front support plate, as seen in the direction of travel, being arranged in front of the swivel shaft of the support plate. In this simple manner, a very good and effective straight guiding of the traveling carriage is obtained.

A second improvement refers to the supporting of the support plate on the mounting plate. This applies in particular to that support plate which also holds the control and the drive of the traveling carriage. However, it can also be used for the other support plates. This support plate has prismatic rollers which engage in a circumferential groove in a bearing ring which, in its turn, is attached to the mounting plate. In this connection, it is logical to develop this circumferential groove in prismatic shape and to have the circumference of the prismatic roller adapted to this shape. Furthermore, however, the circumference of the prismatic roller should be slightly barrel-shaped so that there is only point contact. In this way the turnable mounting of the support plate with respect to the intermediate ring is made substantially more easily movable.

In order that possible play can be adjusted between the prismatic rollers and the bearing ring, it is proposed, in accordance with the invention, that at least the prismatic roller be mounted eccentrically. By the displacement of this prismatic roller, play can be eliminated.

Another improvement made by the invention refers to the connection between support plate and mounting plate. Here, a cover profile should be provided between support plate and mounting plate. The development of this cover profile is of minor importance. However, at least two pins should extend from the cover profile and engage in a recess or a sleeve in the mounting plate. An elastic ring is present in this mounting plate between a head of the pin and a shoulder of the sleeve. In this way, the mounting plate can be pushed slightly in all directions with respect to the cover profile, which considerably facilitates a centering and a transverse balancing of the traveling carriage, particularly at a work station. In particular, a transverse balancing is created for the travel rollers. Of course, it is also conceivable for the mounting plate to be mounted in the manner just indicated directly opposite to the support plates. This is also to be covered by the present invention.

Particularly in the case of a traveling carriage with laterally protruding housing parts in which control and drive for the traveling carriage are located, it has proven advisable to provide a support with respect to the rail which is spaced from the travel rollers. This is effected via support rollers which, in accordance with the invention, pursuant to another feature of the present invention, are arranged displaceable transverse to the rail. The displaceable mounting of these support rollers can be effected in various ways. In accordance with the present embodiment, the support roller is connected via a pivot pin with an angle rail which, in its turn, is mounted displaceably with respect to the housing. For the displaceable mounting there can be used a screw which passes through one leg of the angle rail and upon turning acts like a spindle.

While in accordance with EP-A 0 618 123, brushes which slide along current rails are used to receive current for a drive of the traveling carriage, the feeding of the current is to be obtained in the present invention via a roller of conductive material, preferably a carbon roller. In this way, wear or abrasion, which can lead to disturbances in the system and, in particular, in the control of the traveling carriage, is substantially reduced. The carbon rollers roll on the current-conducting rails. The carbon rollers are preferably mounted swingably and turnably on bearing tongues, they being acted on by a corresponding spring force which swings the bearing tongues against the current feed rails.

Further advantages, features and details of the invention will become evident from the following description of preferred embodiments, read with reference to the drawing, in which.

Figure 1:
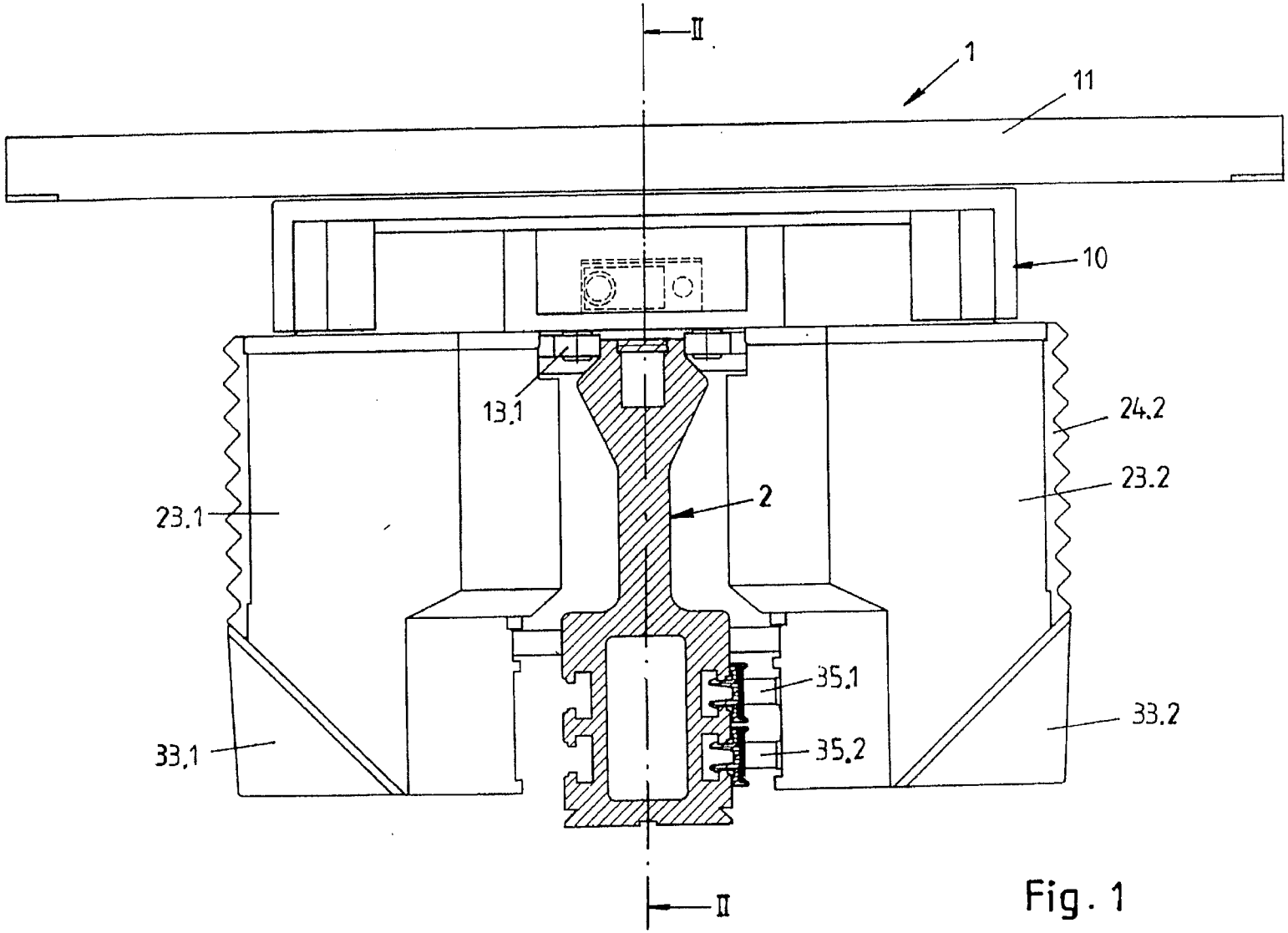
FIG. 1 is an end view of a traveling carriage in accordance with the invention, shown in position of use on a rail shown in cross section of a longitudinal transfer system.
Figure 2:
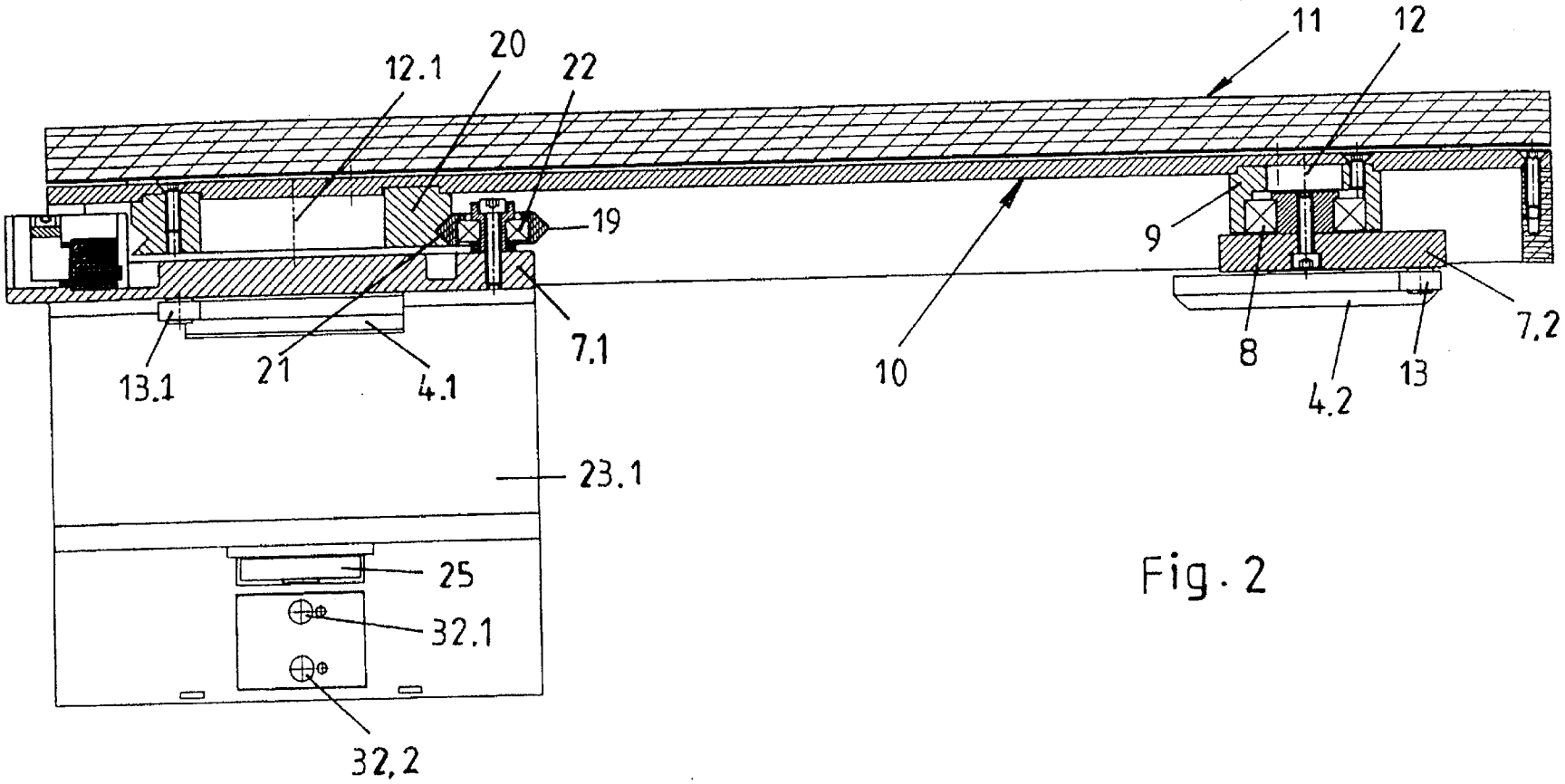
FIG. 2 is a longitudinal section through the traveling carriage of FIG. 1, seen along the line II—II, without rail.

Referring to FIG. 1, a traveling carriage 1 in accordance with the invention is arranged on a rail 2 of a longitudinal transfer system which is otherwise not shown in detail. This traveling carriage 1 serves for instance as workpiece holder for the transporting of workpieces from work station to work station or else also as the holder of material from a warehouse to a work station.

Figure 3:
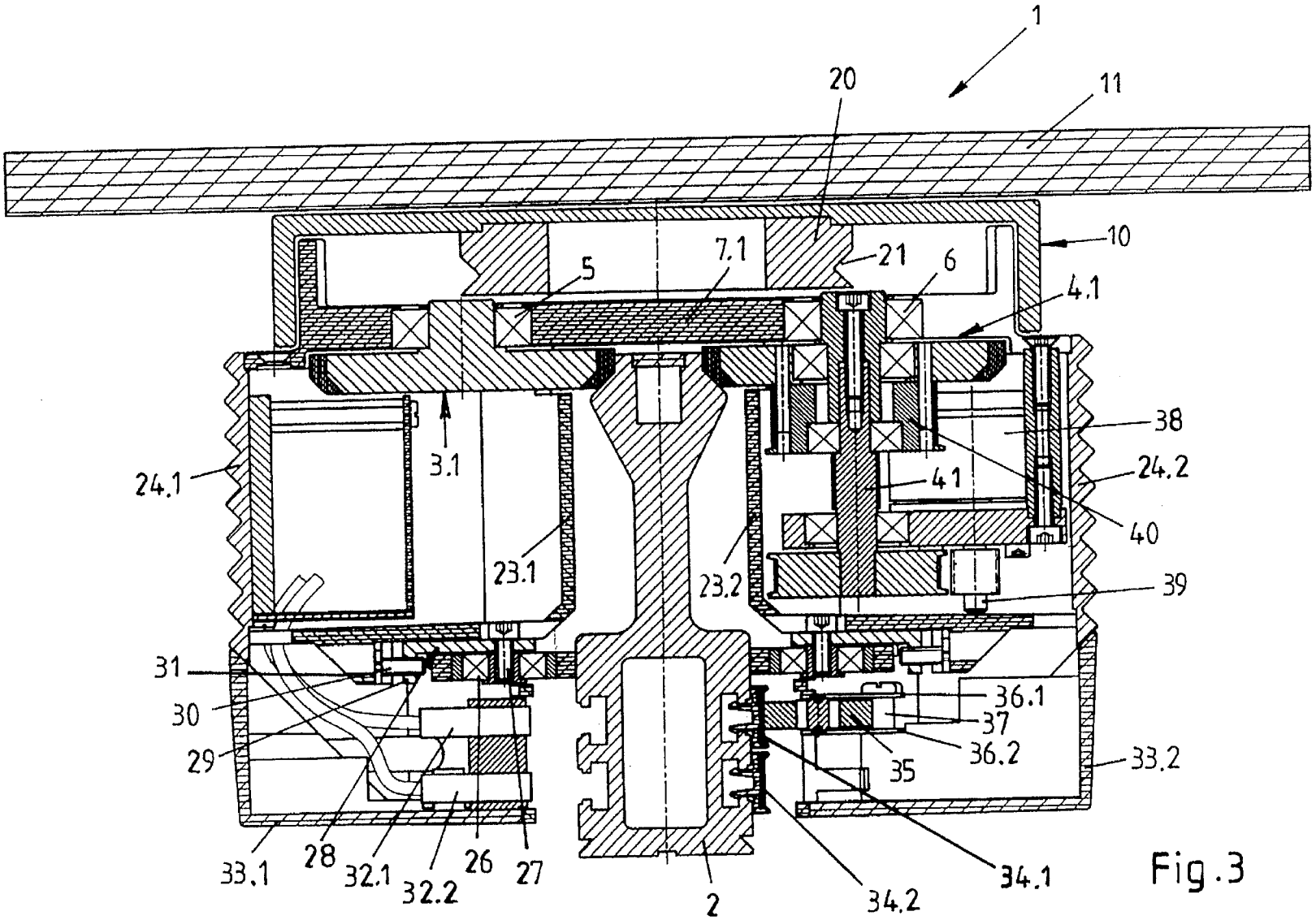
FIG. 3 is a cross section through the traveling carriage of FIG. 1 and the rail shown there.

This traveling carriage 1 preferably travels automatically on the rail 2. For this purpose, on both sides of the rail, there are provided two travel rollers 3.1 and 4.1 (see FIGS. 3 and 4) the outer contours of the resting surface of which are adapted to the rail 2. The corresponding development and adaptation to the rail is described in EP-A 0 618 123, to which reference is had. The travel rollers 3.1 and 4.1 are turnably supported in bearings 5 and 6 in a support plate 7. In this connection, as can be noted from FIG. 4, there is present in this traveling carriage 1 a front support plate 7.1 and a rear support plate 7.2. On the rear support plate 7.2 there are arranged travel rollers 3.2 and 4.2, and on the front support plate 7.1 there are arranged travel rollers 3.1 and 4.1.

Figure 6:
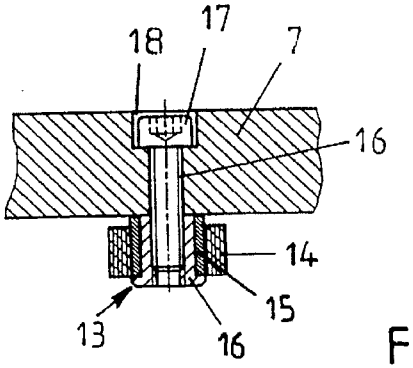
FIG. 6 is a view of an enlarged portion of the traveling carriage of FIG. 1.

The rear support plate 7.2 is connected via a pivot bearing 8 and a bearing housing 9 to a U-shaped cover profile 10, on which an actual mounting plate 11 rests. Behind a swivel shaft 12 for the support plate 7.2 there are two straight-line guide rollers 13, one straight-line guide roller being shown in greater detail in FIG. 6. The straight-line guide roller 13 has a shell 14, preferably of polyurethane, which is vulcanized on a sleeve 15, preferably of bronze. In this connection, the straight-line guide roller turns around a pivot pin 16 which is screwed to the support plate 7. The screw head 17 is seated in a corresponding stepped hole 18.

Straight-line guide rollers 13.1 which are developed in a manner corresponding to the straight-line guide rollers 13 are arranged also on the front support plate 7.1 in front of the swivel shaft 12.1 as seen in the direction of travel.

Furthermore, the support plate 7.1 is connected, however, via prismatic rollers 19 with a bearing ring 20 which is fastened on the U-shaped cover profile 10. This bearing ring 20 has a V-shaped circumferential groove into which the correspondingly contoured circumferential surface of the prismatic roller 19 engages. In this connection, the prismatic roller 19 is slightly barreled so that there is point contact in the circumferential groove 21. The prismatic roller 19 is connected via a bearing 22 with the support plate 7.1.

Figure 4:
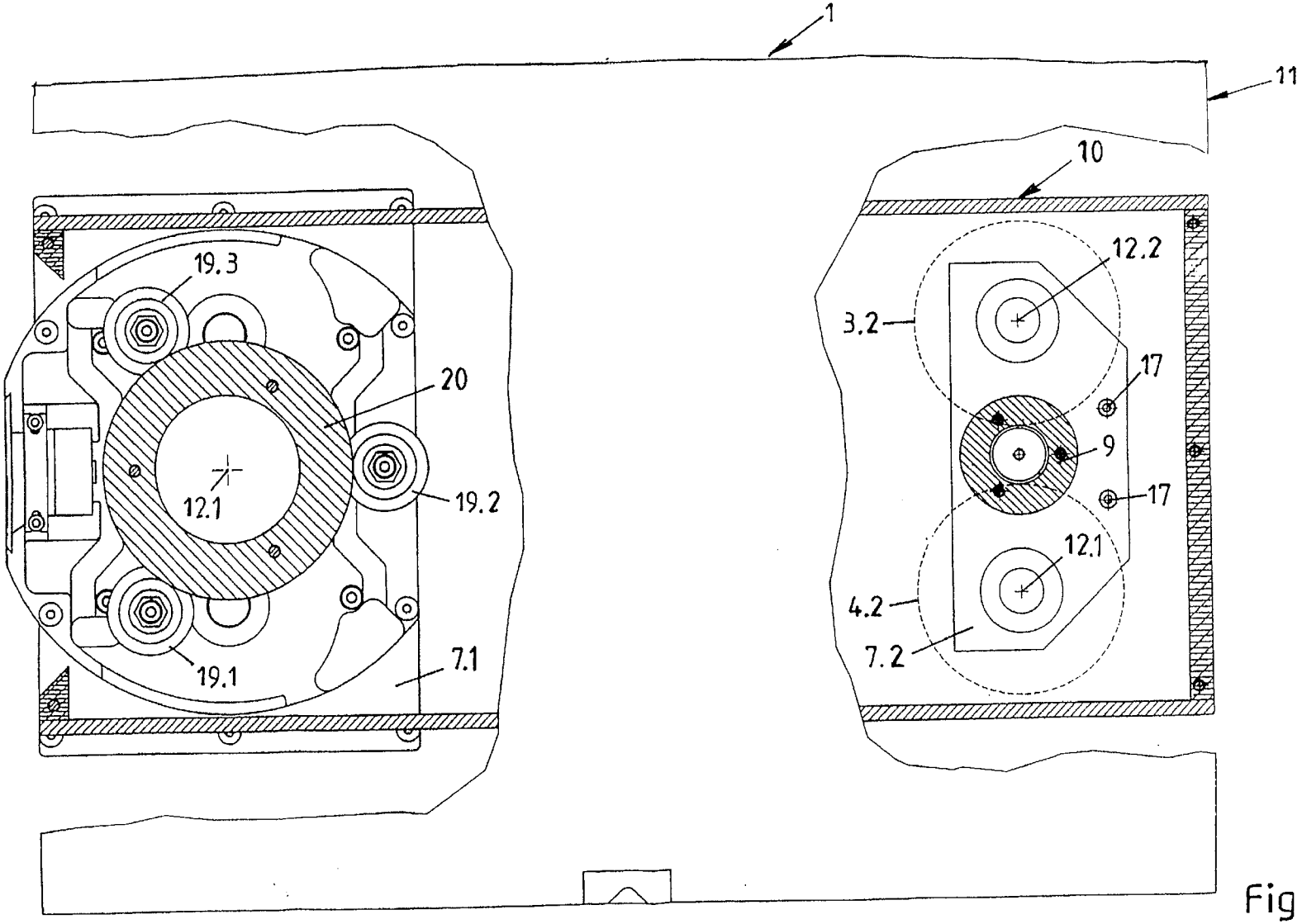
FIG. 4 is a partially broken away top view of the traveling carriage of FIG. 1.

In FIG. 4 it can be noted that three prismatic rollers 19.1, 19.2 and 19.3 are arranged around the bearing ring 20. In this way, the support plate 7.1 can turn around the axis 12.1. One prismatic roller is preferably mounted eccentrically so that play can be adjusted between the rollers 19 and the bearing ring 20.

The travel rollers 3.1 and 4.1 in the front part of the traveling carriage 1 are surrounded, at least in part, by housing shells 23.1 and 23.2. Both housing shells 23.1 and 23.2 are provided towards the outside with cooling ribs 24.1 and 24.2.

In each housing shell 23.1 and 23.2, opposite the corresponding travel roller 3.1 and 4.1 respectively there is arranged a support roller 25 which rests against the rail in the position of use. In this connection, the support roller 25 is connected via a bearing 26 around a pivot pin 37 to an angle rail 28 which is arranged adjustable transverse to the rail 2 on the housing shell 23. A rear leg 29 of this angle rail 28 is passed through by a screw 30, the screw head of which rests against a housing stop 31. The screw 30 is accessible to a screwdriver through the housing stop 31, so that upon rotation it acts as spindle for the angle rail 28. In this way, the angle rail 28 can be moved together with the support roller 25 towards or away from the rail 2. In this connection an adjustment of the support rail 25 with respect to the rail 2 is effected.

Below the support rail 25 and the housing shell 23.1 there can be noted sensors 32.1 and 32.2, which are connected via corresponding wires with a control plate (not shown in detail) in the housing shell 23.1. The sensors 32.1 and 32.2 are seated in this connection in a separate housing part 33.1 which is placed on the housing shell 23.1.

Opposite the housing part 33.1, a current feed point is present on a housing part 33.2 which is connected to the housing shell 23.2. The current is conducted in corresponding current feed rails 34.1 and 34.2. The feeding is effected, however, via carbon rollers 35 which are held turnably between two bearing tongues 36.1 and 36.2 These bearing tongues 36 are held at one end by a pivot pin 37 around which they can also be swung in the direction towards the current feed rail 34 and away from it. In this connection, the carbon rollers 35 which are arranged above each other or their bearing tongues 36 are at an angle of about 90° to each other. Further, there is present on the pivot pin 37 a spring (not shown in detail) which rests in such a manner against a bearing tongue 36 that the carbon roller 35 is held against the current feed rail 34.

Within the bearing shell 23.2 there is a drive for the travel roller 3.1 via which the entire traveling carriage 1 is then moved along the rail 2. With respect to this drive, mention will be made in the present case only of the motor 38, the shaft 39 of which is connected via a toothed-belt drive, not shown in detail, to a drive wheel 40. This drive wheel 40 is firmly connected to the travel roller 4.1.

Figure 5:
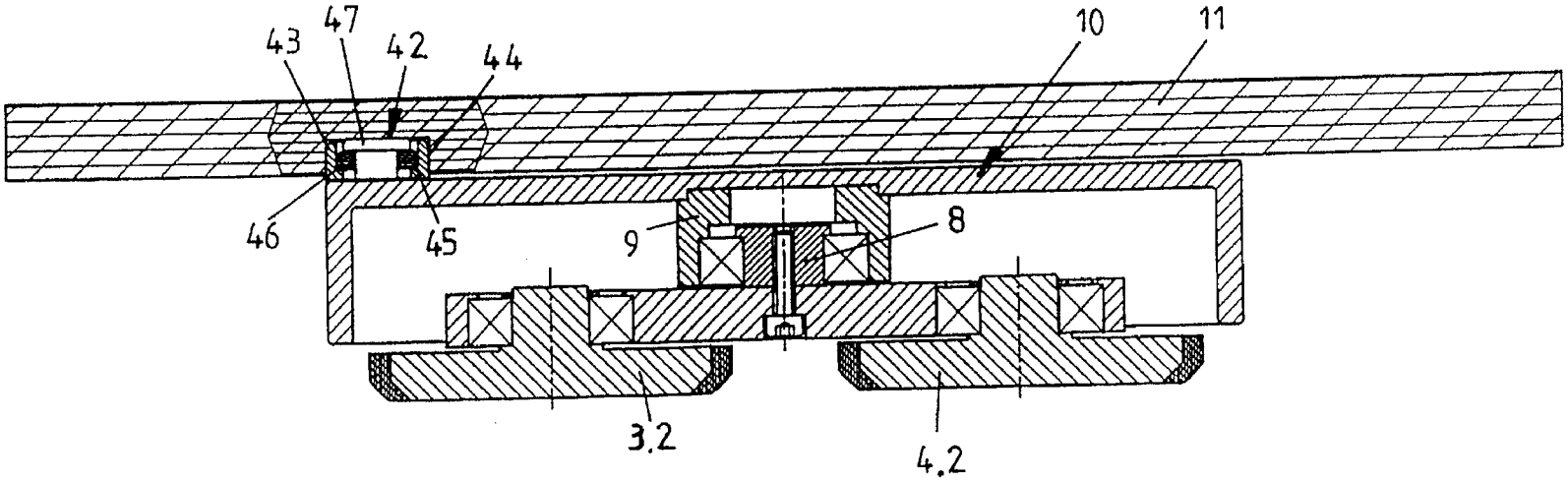
FIG. 5 is a cross section through various parts of the traveling carriage of FIG. 1.

In accordance with FIG. 5, the mounting plate 11 is furthermore mounted "floating" with respect to the cover profile. For this purpose the cover profile 10 engages with a pin 42 of T-shaped cross section into a sleeve 43 in a recess 44 in the mounting plate 11, said sleeve 33 forming an undercut shoulder 45. Against this undercut shoulder 45 there rests an elastic ring 46 which at the same time engages below a head 47 of the pin 42. By this manner of support, the mounting plate 11 can, on the one hand, be moved laterally to a limited extent and, on the other hand, be removed or placed-on in upward direction.

We claim:

1. A traveling carriage for the transporting of workpieces or material, which comprises: a longitudinal transfer system including a rail; travel rollers which move on the rail; at least one support plate supporting said rollers; said support plate being turnably connected around a swivel shaft on the one hand to the travel rollers and on the other hand to a mounting plate for the workpieces or material; straight-line rollers arranged, offset from the swivel shaft, on the support plate on both sides of the rail; and support rollers which are displaceable transversely with respect to the rail and are associated with the travel rollers.

2. A traveling carriage according to claim 1, wherein the mounting plate includes a front and a rear thereof, and on said front and rear is arranged one of said support plates, wherein in each case two of said travel rollers and each support plate has two of said straight-line guide rollers, which in the case of the front support plate are arranged in front of the swivel shaft of the support plate as seen in the direction of travel, and in the case of the rear support plate behind the swivel shaft as seen in the direction of travel.

3. A traveling carriage according to claim 1, wherein the support plate is connected to a bearing ring on the mounting plate via prismatic rollers which engage in a circumferential groove in the bearing ring.

4. A traveling carriage according to claim 3, wherein the circumferential groove is of V-shape and the prismatic rollers are developed in a corresponding manner, but slightly barreled.

5. A traveling carraige according to claim 1, wherein a cover profile is provided between the support plate and the mounting plate.

6. A traveling carriage according to claim 5, wherein a pin extends from the cover profile which engages in a recess or a sleeve in the mounting plate, an elastic ring being provided between a head of the pin and a shoulder of the recess or sleeve.

7. A traveling carriage according to claim 1, including a motor provided for driving at least one of said travel rollers, which motor uses current from a current feed rail on the rail, including an additional roller of conductive material provided for receiving the current.

8. A traveling carraige according to claim 7, wherein the additional roller is arranged swingable about a pivot pin and turnable between two bearing tongues.

9. A traveling carraige for the transporting of workpieces or material, which comprises: a longitudinal transfer system including a rail; travel rollers which move on the rail; at least one support plate supporting said rollers; said support plate being turnably connected around a swivel shaft on the one hand to the travel rollers and on the other hand to a mounting plate for the workpieces or material; straight-line rollers arranged offset from the swivel shaft, on the support plate on both sides of the rail; and including support rollers which are displaceable transversely with respect to the rail and are associated with the travel rollers, wherein the support rollers are connected via a pivot pin to an angle rail which rests via a screw on a housing stop.

* * * * *